United States Patent [19]

Borst

[11] 4,419,084

[45] Dec. 6, 1983

[54] POWER ASSISTED STEERING FOR MARINE PROPULSION DEVICE

[75] Inventor: Gaylord M. Borst, Waukegan, Ill.

[73] Assignee: Outboard Marine Corporation, Waukegan, Ill.

[21] Appl. No.: 106,542

[22] Filed: Dec. 26, 1979

[51] Int. Cl.[3] ..... B63H 25/02

[52] U.S. Cl. ..... 440/58; 440/63; 114/144 R

[58] Field of Search ..... 440/53, 58, 63; 114/144 R, 144 RE, 144 A, 154, 157, 150; 74/388 R, 388 PS, 194–199, 393, 484 R–486, 480 B, DIG. 8; 180/79.1, 79.3, 79.4, 79.5

[56] References Cited

U.S. PATENT DOCUMENTS

| | | | |
|---|---|---|---|
| 2,820,872 | 1/1958 | Carr | 180/79.1 |
| 2,875,722 | 3/1959 | Post | 114/144 R |
| 2,921,479 | 1/1960 | Thomas | 74/194 |
| 2,951,460 | 9/1960 | Pierson | 114/144 R |
| 3,051,886 | 8/1962 | Cadwallader | 114/144 RE |
| 3,631,833 | 1/1972 | Shiminckas | 114/144 R |
| 3,774,568 | 11/1973 | Borst | 114/144 R |
| 4,004,537 | 1/1977 | Nilsson | 114/144 E |
| 4,054,102 | 10/1977 | Borst | 114/144 R |
| 4,241,804 | 12/1980 | Deininger | 180/79.1 |
| 4,295,833 | 10/1981 | Borst | 114/15 D |

*Primary Examiner*—Trygve M. Blix
*Assistant Examiner*—Stephen P. Avila
*Attorney, Agent, or Firm*—Michael, Best & Friedrich

[57] ABSTRACT

Disclosed herein is an outboard motor for a boat having a hull and including a support adapted to be fixed relative to the boat hull, and a propulsion assembly including a rotatably mounted propeller and being connected to the support for pivotal steering movement about a steering axis. The outboard motor also includes a pair of elongated members, coupled together for linear extension and retraction upon rotation of one of the elongated members with respect to the other of the elongated members, an end of one of the members being connected to the propulsion assembly for causing pivotal movement of the propulsion assembly about the steering axis, an assembly for fixing the other of the elongated members against longitudinal movement, and a push pull cable assembly for selectively causing rotation of one of the elongated members with respect to the other of the elongated members.

14 Claims, 2 Drawing Figures

POWER ASSISTED STEERING FOR MARINE PROPULSION DEVICE

FIELD OF THE INVENTION

The invention relates to marine steering systems and particularly to power actuated steering systems for marine propulsion devices such as outboard motors.

BACKGROUND PRIOR ART

Prior art power assisted steering arrangements for marine propulsion units are illustrated for purposes of example in the Pierson U.S. Pat. No. 2,951,460, issued Sept. 6, 1960; in the Cadwallader U.S. Pat. No. 3,051,886, issued Aug. 28, 1962; and in the Shimanckas U.S. Pat. No. 3,631,833, issued Jan. 4, 1972.

Attention is also directed to the Borst U.S. patent application Ser. No. 953,566, filed Oct. 28, 1978, titled "Inboard-Outboard Driving Mechanism Including A Hydraulically Assisted Steering System," and assigned to the assignee of the present invention.

Attention is also directed to the Borst et. al. U.S. Pat. No. 4,054,102, issued Oct. 18, 1977; the Borst et al. U.S. Pat. No. 3,774,568, issued Nov. 27, 1973; and the Post U.S. Pat. No. 2,875,722; issued Mar. 3, 1959.

SUMMARY OF THE INVENTION

The invention includes an outboard motor for a boat, the outboard motor including a support adapted to be fixed relative to the boat hull, a propulsion means including a rotatably mounted propeller, means for connecting the propulsion means to the support for pivotal steering movement about a steering axis, and means for causing pivotal steering movement of the propulsion means. The steering means includes a pair of elongated members, and means for threadably coupling the elongated members together for linear extension and retraction upon rotation of one of the elongated members with respect to the other of the elongated members. One end of one of the elongated members is connected to the propulsion means for causing pivotal movement of the propulsion means about the steering axis during linear extension of the elongated members. The steering means also includes means for fixing the other of the elongated members against longitudinal movement and means for selectively causing rotation of one of the elongated members with respect to the other of the elongated members.

In one embodiment of the invention the means for causing pivotal steering movement includes an electric motor having an output shaft and means for selectively drivingly connecting the output shaft to one of the elongated members for rotatably driving that elongated member.

In one embodiment of the invention the means for causing pivotal steering movement includes means for drivingly connecting the output shaft of the electric motor to the elongated member, an input shaft having a longitudinal axis, and means for supporting the input shaft for rotation about its axis and for linear movement in the direction of its longitudinal axis. Also included are means for drivingly connecting the input shaft to the rotatable elongated member, a first friction wheel driven by the electric motor, and a second friction wheel supported for rotation with the input shaft and having an axis of rotation transverse to the axis of rotation of the first friction wheel. The second friction wheel is movable with the input shaft in the direction of the longitudinal axis of the input shaft between a first position wherein the second friction wheel engages a central portion of the first friction wheel, a second position wherein the second friction wheel engages a second portion of the first friction wheel and is rotatably driven by the first friction wheel in a first rotational direction, and a third position wherein the second friction wheel engages a third portion of the second friction wheel and is rotatably driven by the first friction wheel in a second rotational direction opposite to the first rotational direction.

In one embodiment of the invention the means for causing linear movement of the input shaft includes a coaxial steering cable having a core and a conduit surrounding the core, the core being movable with respect to the conduit, one of the core and the conduit being connected to the propulsion means for applying steering force to the propulsion means, and the other of the core and conduit being connected to the input shaft for causing selective movement of the shaft in the direction of its longitudinal axis.

The invention also includes an outboard motor for a boat, the outboard motor including a support adapted to be fixed relative to the boat hull, a propulsion means including a rotatably mounted propeller, means for connecting the propulsion means to the support for pivotal steering movement about a steering axis, and means for causing pivotal steering movement of the propulsion means. The steering means includes a member having opposite ends, one of the ends being connected to the propulsion leg, and power driven means connected to an opposite end of the member and for driving the member, the power driven means including a screw, a tube threadably housing a portion of the screw, the tube and the screw being linearly extensible in response to relative rotation between the tube and the screw, and one of the screw and the tube being connected to the member. Means are also provided for rotating one of the screw and the tube, the rotating means including an electric motor, and means for selectively drivingly connecting the electric motor to one of the screw and the tube.

The invention also includes an outboard motor for a boat having a hull and a transom, the outboard motor comprising a support adapted to be fixed relative to the hull, a propulsion means including a rotatably mounted propeller, means for connecting the propulsion means to the support for pivotal steering movement about a steering axis, and means for providing power assisted steering movement of the propulsion means. The power assisted steering means includes an electric motor and means operable in response to manual steering to selectively apply the output of the electric motor to effect power assisted steering movement of the propulsion means.

Other features and advantages of the invention are set forth in the following description and claims and in the drawings.

Figure 1:
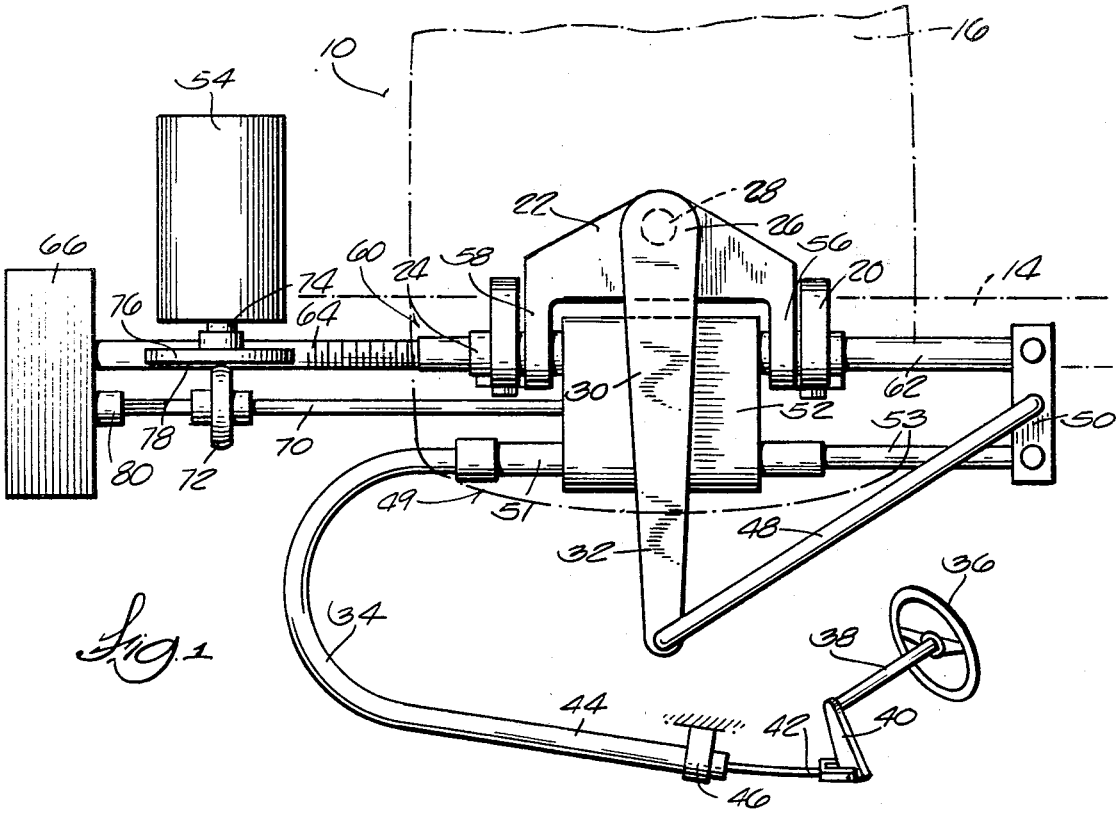
FIG. 1 is a plan view of a steering system for use in steering an outboard motor and embodying the invention.
Figure 2:
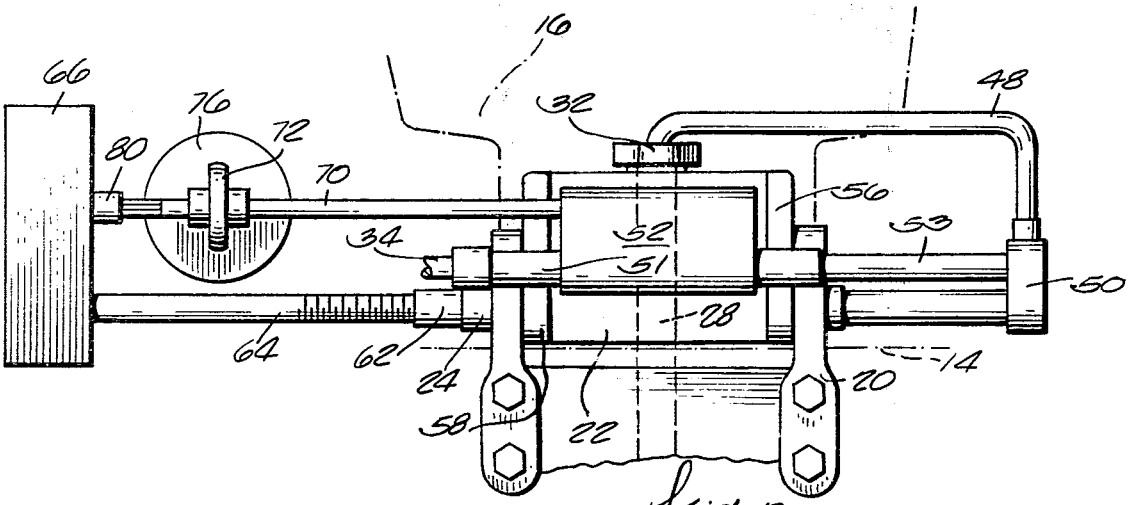
FIG. 2 is an elevation view of the steering mechanism shown in FIG. 1.

Before explaining one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, is should be understood that the phraseology and terminology employed herein is for the purpose of description and should not be regarded as limiting.

DESCRIPTION OF THE PREFERRED EMBODIMENT

Illustrated in the drawings is a marine propulsion unit 10 shown for purposes of example but not by way of limitation as an outboard motor supported by the transom 14 of a boat. The outboard motor 10 generally includes a power head 16.

Means are further provided for supporting the motor 10 for pivotal steering movement about a generally vertical steering axis and for tilting movement about a generally horizontal axis. While the supporting means can have various constructions, in the illustrated arrangement wherein the marine propulsion device comprises an outboard motor, the supporting means includes a transom bracket 20 clamped to the transom 14 and a pivot or swivel bracket 22 connected to the transom bracket by a hollow pivot tube 24 positioned generally horizontally. The swivel bracket 22 is pivotable with respect to the transom bracket 20 about the generally horizontal axis of the pivot tube 24. The outboard motor 10 can be supported for pivotal steering movement with respect to the swivel bracket 22 by any conventional means. In the illustrated construction, however, the swivel bracket 22 includes at its rearward end, with respect to the direction of movement of the boat, a generally vertical elongated bore 26 housing a pivotal kingpin 28. The outboard motor 10 is supported by the kingpin 28 for pivotal movement with the kingpin.

Means are also provided for causing steering movement of the motor 10 about the axis of the kingpin 28. In the illustrated construction, the steering means includes a tiller arm 30 fixed at its rearward end to the kingpin 28 and motor 10 and including a forwardly extending arm portion 32 providing a lever arm for pivoting the kingpin 28 and the motor 10 about the axis of the kingpin. A push-pull steering cable 34 is also provided and is connected between the tiller arm 30 and a steering wheel 36 for causing pivotal steering movement of the motor 10 in response to turning of the steering wheel 36.

The steering means for causing push-pull movement of the cable 34 can have various configurations, but in the present construction the steering wheel 36 is connected to a rotatable shaft 38 and a pivotal lever 40 is fixed to the rotatable shaft and extends radially outwardly therefrom for arcuate movement about the axis of the shaft 38 in response to rotation of the steering wheel 36. One end of the core 42 of the cable 34 is attached to the free end of the pivotable lever 40 and an adjacent end of the conduit or outer casing 44 of the cable 34 is fixedly supported by a bracket 46. Pivotable movement of the steering wheel 36 results in slidable movement of the core 42 within the conduit 44.

Means are also provided for attaching the movable core 42 of the steering cable 34 to the forwardly extending end 32 of the tiller arm 30 for causing pivotal steering movement thereof. While the means for attaching the core 42 of the steering cable 34 to the tiller arm 30 can have various constructions, in the illustrated arrangement such means includes a drag link 48 having one end pivotally attached to a coupler 50 and an opposite end pivotally attached to the free end 32 of the tiller arm 30. The end of the cable 34, opposite that end connected to the steering wheel 36 is connected to a cable anchor assembly 49 comprising a tube 51 fixed to the end of the conduit 44 and fixedly joined to a support block 52. A central rod 53 is fixed to the core 42 of cable 34 and is slideably supported in the tube 51. The free end of the rod 53 is connected to the coupler 50.

Means are also included for providing power assisted steering movement of the motor 10 about the steering axis, such steering assist means including apparatus driven by an electric motor 54 and actuated by movement of the push-pull cable 34 to thereby assist in causing steering movement of the motor in the direction urged by the push-pull cable 34. While the power assist means can have various constructions, in the illustrated arrangement, the support block 52 is supported for linear slidable movement on the tilt axis tube 24 between the arms 56 and 58 of the pivot bracket 22. Since the cable conduit 44 is fixed by means of the tube 51 to the support block 52, during actuation of the push-pull cable 34 wherein the cable core 42 and the rod 53 apply either a pushing or pulling force on the coupler 50, the conduit 44 and tube 51 will apply an equal and opposite force on the support block 52.

The means for providing power assisted steering also includes an elongated linearly extensible member 60 selectively driven by the electric motor 54. The elongated extensible member 60 includes one end connected to the coupler 50 and an opposite end which is secured against linear movement such that linear extension of the extensible member 60 will cause movement of the coupler 50 and the drag link 48 to effect pivotal steering movement of the outboard motor 10. While the elongated linearly extensible member 60 can have various configurations, in the illustrated arrangement, it includes a tube 62 having a threaded bore, the tube 62 being slidably supported in the pivot tube 24 for linear movement therein. One end of the tube 62 is connected to the coupler 50 and an opposite end of the tube 62 receives a threaded rod 64. The threaded rod 64 is journaled at its opposite end in a gear box 66 so as to be rotatably driven but restrained against axial movement.

Means are also provided for causing linear extension of the linearly extensible member 60 in the same direction as the movement of the cable core 42, and in response to movement of the cable core 42, to thereby provide power assisted movement of the coupler 50 and the drag link 48. As set forth above, the cable conduit 44 is fixed to the support block 52 which is in turn supported for slidable movement on the pivot tube 24. An input shaft 70 extends from the support block 52 so as to be freely rotatable with respect to the support block 52 but joined to the support block for movement with the support block 52 in the direction of the longitudinal axis of the pivot tube 24. A driven wheel 72 is fixed to the input shaft 70 intermediate its opposite ends. The electric motor 54 is continuously driven by a suitable source of electric power and includes an output shaft 74 extending perpendicularly to the axis of the input shaft 70, the output shaft 74 supporting a drive wheel 76 having a planar face 78 which engages the peripheral edge of the driven wheel 72. The input shaft 70 is connected in splined relation to a driven shaft 80 in such a manner as to rotatably drive the driven shaft 80 but also to be movable longitudinally with respect to the driven shaft. The driven shaft 80 is connected through the gears of the gear box 66 to the threaded rod 64 whereby rotation of the driven shaft 80 will result in rotation of the threaded rod 64 and with respect to the tube 62 to thereby cause linear extension of the threaded tube 62. It will be understood by those skilled in the art that various means (not shown) can be provided to support the electric motor 54 and the gear box 66. For example, they can be fixedly attached to the transom bracket 20 or to the transom 14.

In operation of the means for providing power assisted steering movement of the outboard motor, in a neutral position, i.e. wherein the outboard motor is stationary with respect to the steering axis, the support block 52 is positioned such that the driven wheel 72, supported by the input shaft 70, is positioned centrally on the planar face 78 of the drive wheel 76 whereby rotation of the drive wheel 76 does not impart rotation to the driven wheel 72.

Since the cable conduit 44 is fixed by the bracket 46, movement of the core 42 with respect to the conduit 44 adjacent the bracket 46 requires similar movement of the core 42 with respect to the conduit at the opposite end of the cable 34, thereby causing relative movement of the rod 53 and the support block 52, the rod 53 moving in one direction and the support block moving in an opposite direction. In the event the steering wheel 36 is rotated to thereby cause movement of the steering cable core 42 with respect to the conduit 44 such that the coupler 50 will tend to move right as seen in FIG. 1, the support block 52 will tend to move left. The resultant movement of the support block 52 causes the driven wheel 72 to shift to the left and away from the axis of the drive wheel 76. Rotation of the drive wheel 76 will then cause rotation of the driven wheel 72, and the consequent rotation of the input shaft 70 will be transmitted through the gear box 66 to cause rotation of the threaded rod 64 in such a direction as to cause longitudinal movement of the threaded tube 62 to the right, thereby assisting steering movement of the coupler 50.

If the steering wheel 36 is turned in the other direction, thereby causing movement of the core 42 to the left, the cable conduit 44 will cause movement of the driven wheel 72 to the right. Accordingly, the rotation of the drive wheel 76 will then cause rotation of the input shaft 70 in a direction causing linear movement of the threaded tube 62 to the left.

Various features of the invention are set forth in the following claims.

I claim:

1. An outboard motor for a boat having a hull, said outboard motor comprising a support adapted to be fixed relative to the hull, propulsion means including a rotatably mounted propeller, means connecting said propulsion means to said support for pivotal steering movement about a steering axis, said means for causing pivotal steering movement of said propulsion means including a pair of of elongated members, means for threadably coupling said elongated members together for linear movement therebetween upon rotation of one of said elongated members with respect to the other of said elongated members, one of said elongated members being connected to said propulsion means for causing pivotal movement of said propulsion means about said steering axis in response to relative movement between said elongated members, means for fixing the other of said elongated members against longitudinal movement, an electric motor having an output shaft which is continuously driven during operation of said outboard motor, and means including a push pull cable for selectively drivingly connecting said output shaft to one of said elongated members to effect rotation thereof.

2. An outboard motor as set forth in claim 1 wherein said elongated members comprise a first tube having a threaded bore therethrough and a screw threadably received in said bore.

3. An outboard motor as set forth in claim 2 and further including means for supporting said propulsion means for pivotal movement about a horizontal axis, said supporting means including a second tube having a longitudinal bore, one of said first tube and said screw being supported in said second tube for slideable longitudinal movement therein.

4. An outboard motor for a boat having a hull and a transom, said outboard motor comprising a support adapted to be fixed relative to the hull, a propulsion means including a rotatably mounted propeller, means for connecting said propulsion means to said support for pivotal steering movement about a steering axis, and means for causing pivotal steering movement of said propulsion means including a pair of elongated members, means for threadably coupling said elongated members together for linear extension and retraction upon rotation of one of said elongated members with respect to the other of said elongated members, one of said elongated members being connected to said propulsion means for causing pivotal movement of said propulsion means about said steering axis during said linear extension, means for fixing the other of said elongated members against longitudinal movement, an input shaft having a longitudinal axis, means for supporting said input shaft for rotation about its axis and for linear movement in the direction of its longitudinal axis, means for drivingly connecting said input shaft to said one of said elongated members, a first friction wheel driven by said electric motor, a second friction wheel supported for rotation with said input shaft and having an axis of rotation transverse to the axis of rotation of said first friction wheel, said second friction wheel being movable with said input shaft in the direction of the longitudinal axis of said input shaft between a first position wherein said second friction wheel engages a central portion of said first friction wheel, a second position wherein said second friction wheel engages a second portion of said first friction wheel and is rotatably driven by said first friction wheel in a first rotational direction, and a third position wherein said second friction wheel engages a third portion of said first friction wheel and is rotatably driven by said first friction wheel in a second rotational direction opposite said first rotational direction.

5. An outboard motor as set forth in claim 4 wherein said means for drivingly connecting said input shaft and said one of said linear members comprises a gear box.

6. An outboard motor as set forth in claim 4 wherein said means for causing linear movement of said input shaft includes a steering cable having a core and a conduit surrounding said core, said core being movable with respect to said conduit, one of said core and said conduit being connected to said propulsion means for applying steering force to said propulsion means, and the other of said core and said conduit being connected to said input shaft for causing selective movement of said shaft in the direction of its longitudinal axis.

7. An outboard motor for a boat having a hull, said outboard motor comprising a support adapted to be fixed relative to the boat hull, propulsion means including a rotatably mounted propeller, means connecting said propulsion means to said support for pivotal steering movement about a steering axis, said means for causing pivotal steering movement of said propulsion means including a steering member having opposite ends, one of said opposite ends being connected to said propulsion means, a screw, a tube threadably housing a portion of said screw, said tube and said screw being linearly relatively movable in response to relative rotation between said tube and said screw, one of said screw and said tube being connected to the other of said opposite ends of said steering member for steering movement thereof in response to linear relative movement between said tube and said screw, and means for rotating one of said screw and said tube, said rotating means including an electric motor which is continuously driven during operation of said outboard motor, and means including a push pull cable for selectively drivingly connecting said electric motor to said one of said tube and said screw to effect rotation thereof.

8. An outboard motor as set forth in claim 7 wherein said electric motor includes an output shaft and wherein said means for rotating one of said screw and said tube further includes means for selectively drivingly connecting said output shaft to said one of said screw and said tube for rotatably driving said one of said tube and said screw.

9. An outboard motor for a boat having a hull, said outboard motor comprising a support adapted to be fixed relative to the boat hull, propulsion means including a rotatably mounted propeller, means for connecting said propulsion means to said support for pivotal steering movement about a steering axis, means for causing pivotal steering movement of said propulsion means including a steering member having opposite ends, one of said ends being connected to said propulsion leg, power driven means connected to an opposite end of said steering member and for driving said steering member, said power driven means including a screw, a tube threadably housing a portion of said screw, said tube and said screw being linearly extensible in response to relative rotation between said tube and said screw, one of said screw and said tube being connected to said opposite end of said steering member, and means for rotating one of said screw and said tube, said rotating means including an electric motor, and means for selectively drivingly connecting said electric motor to said one of said tube and said screw to rotatably drive said one of said tube and said screw, said means for selectively drivingly connecting including an input shaft having a longitudinal axis, means for supporting said input shaft for rotation about its axis and for linear movement in the direction of its longitudinal axis, means for drivingly connecting said input shaft to said one of said elongated members, a first friction wheel driven by said electric motor, a second friction wheel supported for rotation with said input shaft and having an axis of rotation transverse to the axis of rotation of said first friction wheel, said second friction wheel being movable with said input shaft in the direction of the longitudinal axis of said input shaft between a first position wherein said second friction wheel engages a central portion of said first friction wheel, a second position wherein said second friction wheel engages a second portion of said first friction wheel and is rotatably driven by said first friction wheel in a first rotational direction, and a third position wherein said second friction wheel engages a third portion of said first friction wheel and is rotatably driven by said first friction wheel in a second rotational direction opposite said first rotational direction, and means for selectively causing movement of said input shaft in the direction of the longitudinal axis of said input shaft whereby said second friction wheel is selectively movable to said first position, second position and third position.

10. An outboard motor for a boat having a hull, said outboard motor comprising a support adapted to be fixed relative to the hull, propulsion means including a rotatably mounted propeller, means connecting said propulsion means to said support for pivotal steering movement about a steering axis, an electric motor which is continuously driven during operation of said outboard motor and which includes a rotatable output shaft, a member connected to said propulsion means and movable to effect steering movement of said propulsion means, and means including a push pull cable for selectively mechanically drivingly connecting and disconnecting said output shaft to said member in such manner as to selectively displace said member in opposite directions in response to selective driving connection between said output shaft and said member so as thereby to effect power assisted steering movement of said propulsion means.

11. An outboard motor for a boat having a hull and a transom, said outboard motor comprising a support adapted to be fixed relative to the hull, propulsion means including a rotatably mounted propeller, means for connecting said propulsion means to said support for pivotal steering movement about a steering axis, and means for providing power assisted steering movement of said propulsion means, said power assisted steering means including an electric motor and means operable in response to manual steering to selectively apply the output of said electric motor to effect power assisted steering movement of said propulsion means, said means operable to effect power assisted steering movement of said propulsion means including a first friction wheel driven by said electric motor and having a first axis of rotation, and a second friction wheel having an axis of rotation transverse to said first axis of rotation and having a periphery engaging said first friction wheel, means for effecting steering movement of said propulsion means in response to rotation of said second friction wheel, and means for moving said second friction wheel in response to manual steering movement of said propulsion means from a first position wherein said second friction wheel engages said first friction wheel adjacent said axis of rotation, and a second position wherein said second friction wheel engages said first friction wheel at a point spaced from said axis of rotation and wherein said second friction wheel is rotatably driven.

12. An outboard motor as set forth in claim 11 wherein said means for effecting steering movement of said propulsion means in response to rotation of said second friction wheel includes a pair of elongated members, means for threadably coupling said elongated members together for linear extension and retraction upon rotation of one of said elongated members with respect to the other of said elongated members, one of said elongated members being connected to said propulsion means for causing steering movement of said propulsion means in response to extension and retraction of said elongated members, and means for drivingly connecting said second friction wheel to one of said elongated members, whereby rotation of said second friction wheel rotatably drives said one of said elongated members.

13. An outboard motor as set forth in claim 11 wherein said means for displacing said second friction wheel comprises a first member connected to said second friction wheel, a second member connected to said propulsion means and movable to cause pivotal steering movement of said propulsion means, and a push-pull cable having opposite ends and including a core and a casing, said casing being connected at one end to said first member and being anchored at an opposite end, and said core being connected at one end to said second member, and means for causing relative movement of said core with respect to said casing whereby said second member is urged in a first direction and said first member is urged in a direction opposite said first direction to thereby effect power assisted steering.

14. A marine propulsion device for a boat having a hull, said marine propulsion device comprising a support adapted to be fixed relative to the hull, propulsion means including a rotatably mounted propeller, means connecting said propulsion means to said support for pivotal steering movement about a steering axis, an electric motor which is continuously driven during operation of the marine propulsion device and which includes a rotatable output shaft, a member connected to said propulsion means and movable to effect steering movement of said propulsion means, and means including a push pull cable for selectively mechanically drivingly connecting and disconnecting said output shaft to said member in such manner as to selectively displace said member in opposite directions in response to selective driving connection between said output shaft and said member so as thereby to effect power assisted steering movement of said propulsion means.

* * * * *

UNITED STATES PATENT AND TRADEMARK OFFICE

CERTIFICATE OF CORRECTION

PATENT NO. : 4,419,084

DATED : December 6, 1983

INVENTOR(S) : Gaylord M. Borst

It is certified that error appears in the above-identified patent and that said Letters Patent are hereby corrected as shown below:

Claim 9, line 37, delete "leg", insert -- means --.

Signed and Sealed this

Thirtieth Day of July 1985

[SEAL]

*Attest:*

DONALD J. QUIGG

*Attesting Officer*

*Acting Commissioner of Patents and Trademarks*